US005752997A

United States Patent [19]

Roth

[11] Patent Number: 5,752,997

[45] Date of Patent: May 19, 1998

[54] WET CLEANING APPARATUS

[75] Inventor: Paul Roth, Isny, Germany

[73] Assignee: Proair GmbH Gerätebau, Isny, Germany

[21] Appl. No.: 642,449

[22] Filed: May 3, 1996

[30] Foreign Application Priority Data

May 5, 1995 [DE] Germany ..... 195 16 533.0

[51] Int. Cl.[6] ..... B01D 19/00; B01D 47/02

[52] U.S. Cl. ..... 55/222; 55/248; 55/259; 55/274; 55/276; 55/DIG. 3; 15/353

[58] Field of Search ..... 55/248, 250, 244, 55/DIG. 3, 255, 256, 429, 257.1, 259, 317, 318, 274, 276; 15/353

[56] References Cited

U.S. PATENT DOCUMENTS

| | | | |
|---|---|---|---|
| 2,224,202 | 12/1940 | Smellie | 55/429 |
| 3,810,349 | 5/1974 | Rebours | 55/248 |
| 3,821,830 | 7/1974 | Sundheim | 15/321 |
| 3,877,902 | 4/1975 | Eriksson et al. | 55/DIG. 3 |
| 4,418,443 | 12/1983 | Fischer | 55/276 |
| 4,627,858 | 12/1986 | Jacob | 55/126 |
| 4,640,697 | 2/1987 | Erickson, Jr. | 55/248 |
| 4,658,465 | 4/1987 | Keane et al. | 15/323 |
| 4,939,809 | 7/1990 | Park | 15/328 |
| 5,354,347 | 10/1994 | McCoy et al. | 55/245 |
| 5,428,964 | 7/1995 | Lobdell | 55/274 |

*Primary Examiner*—Jay H. Woo
*Assistant Examiner*—Robert Hopkins
*Attorney, Agent, or Firm*—Robert W. Becker & Associates

[57] ABSTRACT

A wet cleaning apparatus having an intake connection and at least one air outlet opening is provided. The apparatus has a blower motor and a container for cleaning liquid. The container is disposed in the immediate vicinity of the motor, either above it, next to it, or around it.

43 Claims, 3 Drawing Sheets

WET CLEANING APPARATUS

BACKGROUND OF THE INVENTION

The present invention relates to a wet cleaning apparatus that has an intake connection and at least one air outlet opening.

Liquid bath vacuum cleaners are known that include a portable undercarriage, a liquid tank, as well as a motor with a separating device. With these known apparatus, the liquid tank is disposed in the lower portion of the apparatus. Disposed thereabove is the motor, which drives a suction fan and the separating device. As a consequence of the three-part construction of the apparatus, it is cumbersome to handle, especially when the liquid is being changed. In addition, the motor must be removed from the tank and must subsequently be withdrawn from the undercarriage. A further drawback is found in particular if immediately after turning the motor off, residual liquid is still present in the vicinity of the separating device and after removal of the liquid tank drops onto the floor or when cleaning the separating device passes into the blower housing. Emptying the liquid is achieved either via the filler or via the intake opening of the liquid tank. Cleaning of the interior of the tank is additionally difficult since in the vicinity of the air intake a structural component extends into the interior of the tank. By disposing the separating device directly over the liquid surface, the entering air, which is forcibly guided through the liquid, carries drops of liquid along upwardly by gas bubbles. These drops of liquid then strike the separating device, thereby partially passing through the separating device. Solid particles that might be carried along are thereby not totally separated off and again exit at the air outlet. When the apparatus is again turned off, cleaning liquid can evaporate into the motor disposed thereabove. The water vapor then adheres to parts of the apparatus, such as a turbine, the motor itself, parts of the housing, and on dirt deposits that are deposited on these parts. As a result of this moisture, mold fungus and the like forms on the parts of the apparatus and can be released into the air of the room when the apparatus is next used. A further drawback is that for filling and emptying the filter liquid, with the heretofore known apparatus the relatively heavy motor unit must be lifted from the liquid tank and must then be placed, for example, on the floor. So that the separating device achieves the desired effect, these known vacuum cleaning apparatus must operate at high motor speeds, so that these apparatus are very loud. There also exists the danger that the apparatus will draw in too much liquid, thereby damaging the motor or turbine.

It is therefore an object of the present invention to embody a wet cleaning apparatus of the aforementioned general type in such a way that the formation of mold on parts of the apparatus is prevented, and handling of the apparatus is made easier.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
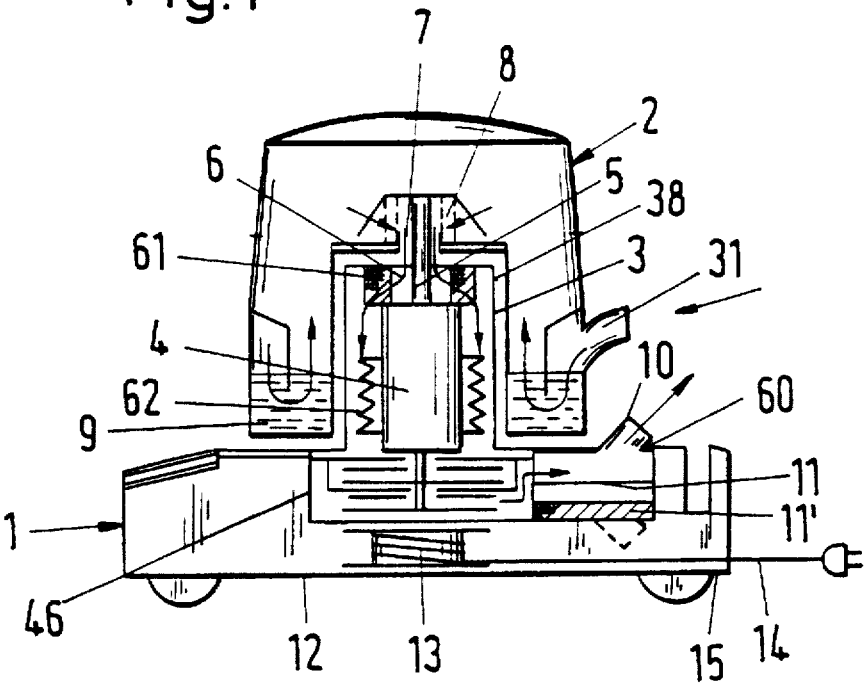
FIG. 1 is an axial cross-sectional view of one exemplary embodiment of the inventive wet cleaning apparatus.

The wet cleaning apparatus of the present invention includes a blower motor and a container for cleaning liquid, wherein in particular the liquid container is disposed in the immediate vicinity of the blower motor, namely over, around, or to the side next to the motor.

As a consequence of the inventive configuration, the liquid container is therefore disposed over the motor, next to the motor, or around the motor. Thus, in a simple manner cleaning liquid is prevented from evaporating into the motor when the apparatus is shut off. Consequently, formation of mold on apparatus components is reliably prevented. When a separating device is used, it is also possible to prevent splashed water and coarse dirt from reaching the separating device. If vibrations occur, for example during use of the apparatus, and also if the apparatus is tipped or falls over, the cleaning liquid can no longer come into contact with the separating device. As a consequence of the inventive arrangement of the liquid container, filling and emptying thereof can also be accomplished in an easy manner, since for this purpose it is no longer necessary to lift off the blower motor. At the same time, the inventive arrangement reduces the operating noise of the apparatus. In addition, a relatively small apparatus size and a distinct reduction in weight can be achieved. A further advantage is that the center of gravity of the apparatus is displaced as far to the bottom as possible, thereby achieving maximum stability. Finally, due to the low evaporation of liquid into the motor if a separating device is provided its function can be improved since the suction or intake air is only slightly loaded with liquid and solid particles. A particular advantage of the inventive arrangement is that when the apparatus is shut off, the apparatus components that are disposed above the motor are dried by the rising warm air without auxiliary means, thereby also reliably preventing the formation of mold fungus. The inventive apparatus advantageously comprises only two main components, namely the liquid container and an apparatus undercarriage that carries the motor and possibly a cable reel-in mechanism.

Further specific features of the present invention will be described in detail subsequently.

DESCRIPTION OF PREFERRED EMBODIMENTS

Referring now to the drawings in detail, the illustrated wet cleaning apparatus is a so-called liquid suction apparatus that is used, for example, for cleaning floors and the like. The apparatus has a portable undercarriage 1 on which is disposed a liquid container 2. The undercarriage 1 is preferably centrally provided with an upwardly projecting housing part 3 in which is accommodated a motor 4. This motor is disposed upright and has an upwardly projecting motor shaft 5 that projects upwardly through an opening 6 of the housing part 3. Connected to the motor shaft 5 via a coupling 7 is a separator 8 that is known per se and will therefore not be described in detail. The separator 8 is accommodated in the liquid container 2, which contains liquid 9, preferably water, through which the drawn-in air is guided in a manner to be described subsequently.

The undercarriage 1 is provided with at least one air outlet 10 that is disposed in the region next to the liquid container 2 and is directed upwardly at an angle. Disposed within the undercarriage 1 in the region in front of the air outlet 10 is at least one filter 11, which also serves as a sound absorber or muffler. The filter 11 is advantageously embodied as a reversible cassette that can be turned over when one side becomes dirty.

Provided directly over the base 12 of the undercarriage 1 is a cable reel 13 on which the power line 14 can be wound. The cable reel 13 is disposed below the motor 4, and its axis is aligned with the axis of the motor. The power line 14 is guided to the outside through an opening 15 in one side wall of the undercarriage 1. Since the cable reel 13 is disposed in the region below the motor 4 just over the base 12 of the undercarriage 1, the power line can be guided out of the undercarriage 1 near the base 12. Since the base 12 of the undercarriage 1 is in addition only slightly above the floor surface, the pulled-out power line 14 does not represent a tripping situation while cleaning is being done with the apparatus.

Figure 4:
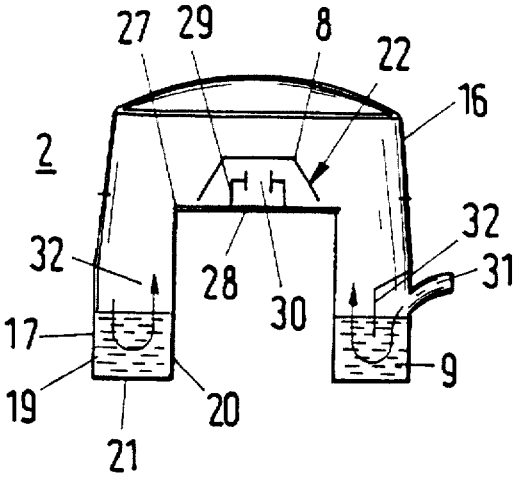
FIG. 4 is an axial cross-sectional view of a liquid container of the wet cleaning apparatus of FIG. 1.
Figure 5:
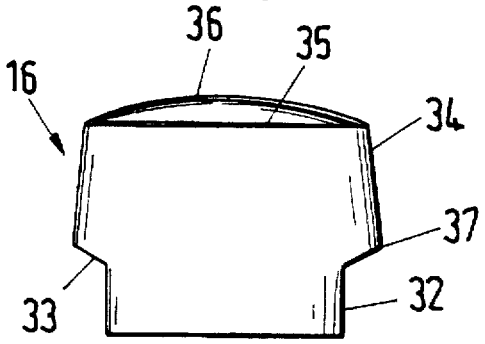
FIG. 5 is an axial cross-sectional view of an upper container part of the liquid container of FIG. 4.
Figure 6:
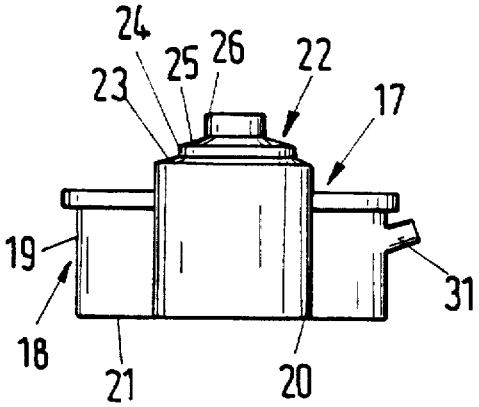
FIG. 6 is an axial cross-sectional view of a lower container part of the liquid container of FIG. 4.

The liquid container 2 comprises an upper container part 16 and a lower container part 17 (see FIGS. 4 to 6). These two parts 16 and 17 are detachably interconnected so that easy cleaning and/or maintenance of the liquid container 2 is ensured. In addition, the liquid container 2 can be easily and hence economically assembled. The upper container part 16 has at least one (non-illustrated) venting opening that automatically opens when the wet cleaning apparatus is turned off. For this purpose, a spring-biased closure member is advantageously used. The spring force is such that when the wet cleaning apparatus is turned on the closure member part is displaced into its closing position against the spring force by the partial system vacuum that results in the apparatus.

The lower container part 17 has an annular holding part 18 for the liquid 9. The holding part 18 has an outer annular wall 19 as well as an inner annular wall 20 that is disposed coaxial to the outer wall 19. Both annular walls 19, 20 are interconnected by a base 21 that extends perpendicular thereto. The inner annular wall 20 projects axially beyond the outer annular wall 19. At its upper end, the inner annular wall 20 merges into a dome part 22 on which is seated the separator 8 (FIG. 1). The dome part 22 is hollow and has adjoining the end face of the annular wall 20 a frusto-conical wall 23, adjoining it a cylindrical wall 24, adjoining it a further frusto-conical wall 25, and adjoining it a further cylindrical wall 26. The dome part 22 is coaxial to the axis of the lower container part 17 and is open throughout, so that the motor shaft 5 (FIG. 1) as well as the corresponding shaft of the separator 8 can project through the dome part 22.

In FIG. 4, the lower container part 17 is provided with a differently-embodied dome part 22. The cylindrical annular wall 20 of the lower container part 17 merges with a cover 22 that is disposed perpendicular thereto and that has a central opening 28. Extending perpendicularly from the cover 27 is a cylindrical wall 29 that extends along the rim of the opening 28 and is angled-off at its upper free rim. The separator 8 is disposed in the region above the cover 27 in such a way that, when viewed in the axial cross-section of FIG. 4, it surrounds the cylindrical wall 29. Projecting into the dome part 22 is the shaft 30 of the separator 8, which is coupled via the coupling 7 (FIG. 1) with the motor shaft 5.

As shown in FIG. 6, provided in the cylindrical outer annular wall 19 is an air inlet connector 31 that is provided in the vicinity of the upper edge of the wall 19 and extends upwardly at an angle.

The upper container part 16 has a cylindrical lower wall 32 that merges via a frusto-conical wall 33 with a conical wall 34 that tapers upwardly in a direction opposite to that of the intermediate wall 33. At its upper end, the conical wall 34 is closed by a cover 35 that extends perpendicular to the longitudinal axis of the upper container part 16. Provided on the cover 35 is at least one handle 36, which extends from the upper edge of the conical wall 34, which in the axial direction is longer than the cylindrical wall 32. The conical wall 34 projects downwardly slightly beyond where it connects to the intermediate wall 33 (FIG. 5). This projecting edge 37 cooperates with the lower container part 17. In order to achieve a tight connection between the upper and lower container parts, a sealing means can be disposed between the edge 37 and the outer annular wall 19 of the lower container part 17.

In the assembled state, the cylindrical wall 32 of the upper container part 16 extends into the annular holding part 18 (FIG. 4). The length of the wall 32 is such that it extends downwardly beyond the air inlet connector 31 in a direction toward the base 21 of the lower container part 17. The intermediate wall 33 is disposed in the region above the air inlet connector 31 so that the air that enters through the connector 31 cannot flow directly upwardly into the upper container part 16. Rather, the air entering through the air inlet connector 31 is deflected downwardly by the intermediate wall 33 and the cylindrical wall 32 of the upper container part 16, so that the air must pass into the liquid 9. The cylindrical wall 32, and the frusto-conical wall 33 of the upper container part 16 that rises upwardly at an angle, thus form a deflection mechanism for the dirty air that enters. The cylindrical wall 32 projects far enough into the liquid that the dirty air must flow downwardly over a significant distance through the liquid 9 and below the cylindrical wall 32 (see the arrow in FIG. 4).

As shown in FIG. 1, the liquid container 2 is placed upon the housing part 3 of the undercarriage 1. The height of the housing part 3 of the undercarriage 1 can be such that the cover 27 of the liquid container 2 rests upon the housing part 3. However, it is also possible to place the base 21 of the liquid container upon the upper side of the undercarriage 1. It is furthermore possible to securely interconnect the liquid container 2 and the undercarriage 1 by a latching mechanism or the like. However, it is also possible to loosely place the liquid container 2 upon the housing part 3. Since the liquid container 2 is filled with liquid 3 during the cleaning process, the liquid container is heavy enough that it will be reliably held on the undercarriage 1 without any additional securing means.

Even when the lower container part 17 of the liquid container has the embodiment shown in FIG. 6, the liquid container can be held on the undercarriage 1 in the manner described.

For the cleaning process, the appropriate suction hose is connected to the air inlet connector 31 in a known manner. The power line 14 is withdrawn from the undercarriage 1 and plugged in. The suction process can now be carried out. The suction air, which is full of dirt, passes via the air inlet connector 31 into the liquid 9, where it is kept in contact with the liquid for a sufficient length of time by the described deflection mechanism 32, 33. The air that passes through below the cylindrical wall 32 is draw in by the separator 8, which is rotatably driven by the motor shaft 5. At the separator 8, dirt particles that are still present in the suction air are restrained in a known manner while the air is guided through non-illustrated openings in the separator 8 downwardly in the direction of the flow arrows shown in FIG. 1. The air passes through the opening 6 in the upper side of the housing part 3 of the undercarriage 1 into at least one flow chamber 38 (FIG. 1) that preferably has a ring-shaped configuration and is disposed between the inner wall of the housing part 3 and the motor housing. In this flow chamber 38 the cleaned air flows downwardly into the undercarriage 1 and is guided by the filter 11 to the air outlet, where the cleaned air is again discharged. The flow chamber 38 can, however, also be divided into individual flow channels by fins or other elements that are distributed over the periphery.

As the air passes through the liquid 9, the dirt and/or dust particles that are present in the drawn-in air remain in the liquid 9. Dirt or dust particles that are still present in the air are then separated from the air by the separator 8 so that cleaned air is discharged at the air outlet 10. Since the liquid container 2 surrounds the housing part 3, and hence the motor 4 disposed therein, the liquid container 2 works as a muffler unit that dampens the noises caused by the motor 4 in an outstanding manner. Thus, a separate noise-dampening means is not required. As a consequence of the deflection mechanism 32, 33 an undesired access of liquid to the separator 8 is prevented in a simple manner. The frusto-conical intermediate wall 33 covers the in-flow region of the dirty air toward the top, so that the splashes that occur as this dirty air enters the liquid 9 are intercepted or taken care of by this intermediate wall 33 as well as by the annular wall 32. As the air flow passes through the liquid 9 it is calmed, so that the air that flows upwardly out of the liquid 9 after passing below the cylindrical wall 32 produces no splashing or at most very little splashing. The danger of this splashing reaching the separator 8 is very low since the separator is spaced quite a distance from the liquid 9 in the region above the motor 4 and the housing part 3. Therefore, the separator 8 does not get dirty during use of the wet cleaning apparatus, so that the cleaning effect thereof remains outstanding even when the wet cleaning apparatus is used for a long period of time.

The described configuration of the liquid container results in a low center of gravity of the wet cleaning apparatus so that there is no danger that it will tip over during the cleaning process. In addition, an optimum sound dampening or absorption is achieved due to the two annular walls 19, 20 of the lower container part 17 as well as by the wall of the housing part 3 and by the flow chamber 38, so that the wet cleaning apparatus operates at a very low noise level. For this reason, additional noise-reducing measures, such as noise dampening elements, for example noise dampening plates and the like, are not required.

The liquid container 2 is advantageously connected to the undercarriage 1 by means of a non-illustrated central fastening means. In this way, the liquid container 2 can be very easily removed from or connected to the undercarriage 1. The upper container part 16 is provided with the handle 16 via which the liquid container can be raised from the undercarriage 1. The heavy motor remains on the undercarriage and need not be lifted. As a result, it is very easy to change or replace the liquid 9. Since the separator 8 is disposed on the lower container part 17, it is removed when the liquid container 2 is raised from the motor shaft 5. The coupling between the motor shaft 5 and the separator shaft 30 is in the form of a snap-in coupling that enables an easy disengagement of the coupling. This has the advantage that the user of the wet cleaning apparatus must actually hold the separator 8 when the liquid container 2 is being emptied. The user can then easily recognize whether or not the separator 8 is dirty and must be cleaned. This ensures that the separator 8 will also be kept clean for an optimum cleaning. The liquid container 2 that is lifted from the undercarriage can be easily cleaned. The upper housing or container part 16 can be removed from the lower housing or container part 17, thus making the separator 8 easily accessible.

The stability of the wet cleaning apparatus is achieved not only by the described configuration of the wet cleaning apparatus; also of critical significance in this respect is the fact that the cable reel 13 is disposed near the base 12 of the undercarriage 1 in the region below the motor 4. As a result, the wet cleaning apparatus has an extremely low center of gravity. The cable reel 13 is embodied in such a way that it is spring loaded in the reeling-in direction. Therefore, the cable reel 13 automatically reels in the power line, as is known.

The upper container part 16 is embodied in such a way that no liquid can reach the separator 8, even if the apparatus is placed on its side. If the liquid container 2, or even the entire wet cleaning apparatus, is placed upside down, the liquid 9 collects on the cover 35 of the upper container part 16, which now forms the underside. The cover 35 is spaced from the separator 8 by such a distance that the liquid cannot reach the separator. This also prevents the liquid from reaching the housing part 3, and hence the motor 4, via the flow chamber 38.

Figure 11:
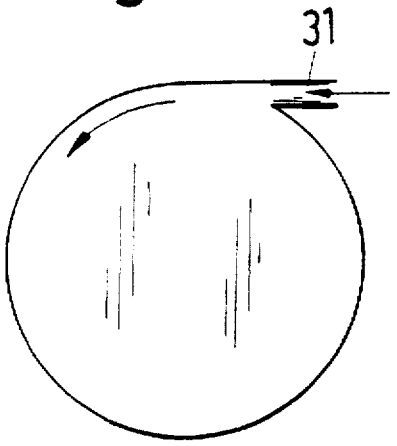

It is advantageous for the dirty air that enters via the air inlet connector to be held in contact with the liquid 9 as long as possible. The longer that the dirty air is in contact with the liquid 9, the greater is the amount of dirt and dust particles that can bond or associate with the water, thus improving the separation of these particles. In order to achieve this long retention time in the liquid 9, a rotational movement is advantageously imparted to the liquid. This rotation is easily achieved by the dirty air itself that is to be cleaned. FIG. 11 schematically illustrates one possibility for imparting rotation to the liquid by means of a tangential introduction of the dirty air via the air inlet connector 31. In this connection, the rotation of the liquid 9 is effected in the same direction as the rotation of the separator 8. The dirty air that flows in via the tangentially disposed air inlet connector has imparted thereto a circular flow and initially flows in the region between the outer annular wall 19 and the cylindrical wall 32 (FIG. 4). In so doing, the coarse dirt is optimally removed from the air since as a consequence of this circular flow a long retention time of the dirty air in the liquid 9 is achieved. After passing below the wall 32, the clean air passes upwardly in the manner described and is drawn in by the separator 8, on which fine particles that might still be present in the air are separated out.

Figure 10:
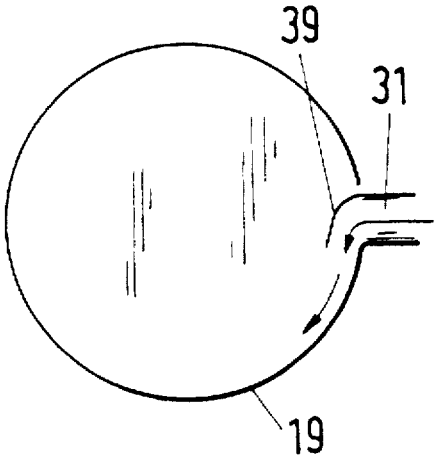
FIGS. 10 and 11 are schematic cross-sectional views of the inlet region of the suction or intake air of the inventive wet cleaning apparatus.

It is also possible to have the direction of rotation of the liquid 9 be opposite to the direction of rotation of the separator by an appropriate introduction of the suction air. This has the advantage that the suction air is slowed down above the liquid 9 by the flow. Thus, the suction air can carry along fewer water drops and will transport correspondingly fewer drops or solid particles to the separator 8. In order to achieve this direction of flow, which extends counter to the direction of rotation of the separator 8, a deflection means 39 adjoins the air inlet connector 31, as indicated schematically in FIG. 10. This deflection means 39 is formed by a deflection plate that in the in-flow region is connected to the inner wall of the outer annular wall 19. At a distance from the annular wall 19, the deflection plate 39 is angled off in such a way that the dirty air that is flowing in has inherently imparted thereto a circulation movement within the liquid 9. The deflection means 39 is disposed in such a way that the direction of flow is counter to the direction of rotation of the separator 8. As shown in FIG. 10, as viewed in the direction of flow the deflection plate 39 is connected to the rear edge of the air inlet connector 31 and advantageously extends over the entire height of the cylindrical wall 32 of the liquid container 2 (FIG. 4).

Arranging the separator 8 in the region above the motor 4 has the further advantage that the warm air, which is rising from the motor 4 through the opening 6 in the housing part and through the opening 28 in the cover 27 of the liquid container 2, must reach the separator 8, which is thereby optimally dried after the conclusion of the cleaning process. The warm air radiated from the motor 4 also passes via these openings into the interior of the liquid container 2, so that the inner walls thereof also have warm air supplied to them. This avoids the formation of mold fungus. Therefore, there is also no danger that during the next cleaning process the mold fungus would be released into the air of the room.

As a consequence of the filter 11 that is disposed in the region upstream of the air outlet 10, it is very easy to be able to use the discharged air as compressed air. This is especially the case if a noise-dampening cassette, which is also called a reversible cassette, is used as the filter 11. The noise-dampening cassette 11 can additionally be equipped with a filter system that serves for trapping microparticles. The filter system can optionally comprise a dry or wet filter element or liquid bath.

In FIG. 1, the reversed position of the noise-dampening cassette 11 is shown by dashed lines. The air outlet connector 1 0 is provided on the noise-dampening cassette 11 and in the reversed position within the undercarriage 1 is directed downwardly at an angle. The filter part 11' is then disposed in front of an opening 60 in the upper side of the undercarriage 1. In the solid-lined position indicated in FIG. 1, the air outlet connection 10 projects through the opening 60.

Downstream of the separator 8, at least one preferably replaceable filter element 61 can be provided in order to trap dirt particles and droplets that have not been separated-off by the separator 8. The filter element 61 is accommodated in the housing part 3. The air must pass through the filter element 61 before it reaches the blower motor 4. The filter element 61 ensures that no dirt will act upon the inner housing walls with which the discharged air comes into contact.

The filter element 61 preferably comprises a metal mesh or some other material that is resistant to chemicals or temperature so that the filter element can be cleaned in a wash liquid or can be heated up to destroy bacteria.

FIG. 1 also illustrates the possibility of heating up the discharged air via a heating means 62 that is accommodated in the housing part 3 in the region between the separator 8 and the blower motor 4. The heated-up air can be used for attachments or accessories.

If the filter element 61 is disposed in the housing part 3 between the separator 8 and the blower motor 4, the heated-up discharged air can be used for drying the filter element 61 and the separator 8 after the wet cleaning apparatus has been turned off. In this case, the heating means 62 is disposed between the filter element 61 and the blower motor 4.

Finally, it is also possible to provide a heating means 63 in the region of the air outlet connector 10 in order to heat up the discharged air immediately prior to its exiting via the air outlet connector 10.

Figure 7:
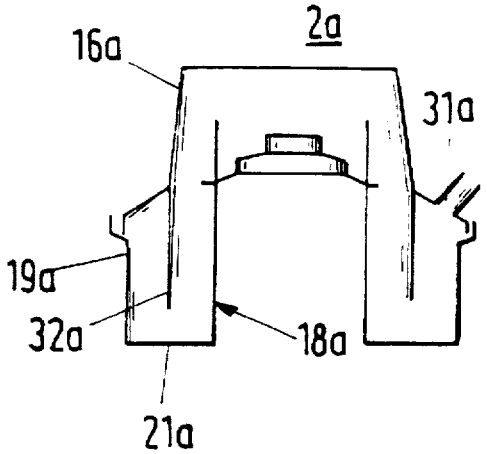
FIGS. 7–9 are views similar to FIGS. 4–6 of a further exemplary embodiment of a liquid container of the inventive wet cleaning apparatus.
Figure 8:
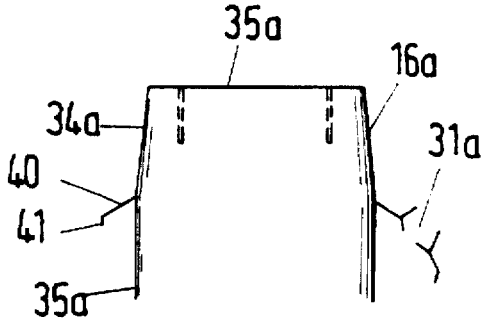
Figure 9:
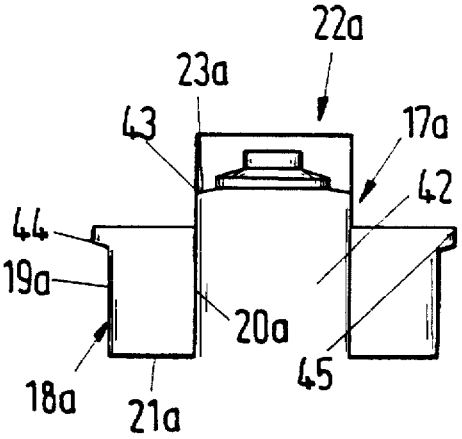

FIGS. 7 to 9 show a liquid container **2*a* where the air inlet connector 31*a* is provided on the upper container part 16*a*. The upper container part 16*a* again has a cylindrical wall 32*a* that extends into the annular holding part 18*a* of the lower container part 17*a* (FIG. 7). In contrast to the previous embodiment, however, the cylindrical wall 32*a* directly adjoins the conical wall 34*a*, which tapers upwardly. The upper container part 16*a* has a cover 35*a* that like the previous embodiment has a planar configuration and forms the upper termination of the upper container part 16*a***.

At the transition between the cylindrical wall **32*a* and the conical wall 34*a*, the upper container part 16*a* is provided with a circumferential flange 40 (FIG. 8) that has the shape of a conical shell and has a downwardly angled-off free edge 41. By means of the edge 41, the upper container part 16*a* rests upon the lower container part 17*a*. As with the previously described embodiment, the cylindrical wall 32*a* of the upper container part 16*a* is spaced from the base 21*a* of the lower container part 17*a*. As a consequence, in a manner to be described subsequently, the dirty air that flows through the air inlet connector 31*a* can flow through beneath the cylindrical wall 32*a*. As shown in FIG. 7, again as with the previous embodiment, the cylindrical wall 32*a* is disposed approximately in the middle of the annular holding part 18*a* for the liquid 9. In the region between the cylindrical wall 32*a* and the outer annular wall 19*a*, the flange 40 covers the annular holding part 18*a* toward the top. The air inlet connector 31*a* is provided in the flange 40** and is advantageously directed upwardly at an angle.

The lower container part **17*a* has essentially the same configuration as with the previous embodiment. It comprises the two coaxially disposed cylindrical annular walls 19*a* and 20*a* that are interconnected by the flat base 21*a*. The radially inwardly disposed annular wall 20*a* extends beyond the radially outwardly disposed annular wall 19*a* in the axial direction. The dome part 22*a*, in contrast to the previous embodiment, is disposed within the receiving chamber 42 that is surrounded by the annular wall 20*a*, which extends axially beyond it. As with the previous embodiment, the non-illustrated separator is rotatably mounted on the dome part 22*a*. This dome part 22*a* has a conical wall 23*a* that adjoins the inner side of the annular wall 20*a*. As with the embodiment of FIG. 6, the conical wall 23*a* is inclined radially outwardly and downwardly, so that liquid that drips from the separator can flow downwardly on the wall 23*a* and back into the liquid 9. Since in the embodiment of FIG. 9 the annular wall 23*a* extends beyond the dome part 22*a*, drain openings 43 are distributed over the periphery of the annular wall 20*a*; these drain openings 43 are delimited toward the bottom by the conical wall 23*a*. As a result, liquid that drips from the separator onto the wall 23*a* can pass downwardly via the drain openings 43** into the liquid.

At its upper end, the annular wall **19*a* is angled off outwardly in such a way that a conical wall 44 connects that annular wall 19*a* with an upper, cylindrical, axially relatively short annular wall 45**.

The upper container part **16*a* is again detachably connected to the lower container part 17*a*. The upper container part 16*a* is placed in the lower container part 17*a* in such a way that its downwardly projecting edge 41 rests upon the annular wall 44 of the lower container part 17*a*. The two container parts 16*a*, 17*a*** are, of course, interconnected in a sealed manner.

As described in detail in conjunction with FIG. 1, the liquid container **2*a*** is placed upon and secured to the central housing 3 of the undercarriage 1. During this placement process, the separator shaft 30 is disposed on the motor shaft 5. As with the previous embodiment, this connection can be a positive and/or frictional connection. The separator shaft 30 can also be drivingly connected with the blower motor 4 via a non-illustrated magnetic drive. Such a drive connection can also be provided for the previous embodiment. The liquid container 2*a* is advantageously connected to the undercarriage via a central closure means. The suction hose is connected to the air inlet connector 31*a*. After the motor 4 is turned on, the shaft 30 of the separator 8 is rotatably driven by the motor shaft 5. The dirty air that flows in flows into the liquid 9, where the dirt particles are captured by the liquid, which is preferably water. The in-flow region of the dirty air can, as described in conjunction with FIGS. 10 and 11, have such an embodiment that a long retention time of the dirty air in the liquid 9 is achieved. As with the previous embodiment, the annular flow of the liquid 9 as well as of the dirty air achieves a uniform distribution of the air and a high degree of cleaning of the dirty air. The air passes below the cylindrical wall 32*a* and flows upwardly in the region between the outer wall 32*a*, 34*a* of the upper container part 16*a* and the inner annular wall 20*a* of the lower container part 17*a*. At the cover 35*a* of the upper container part 16*a*, the air, which has already been extensively cleaned, is deflected to the separator. The separator 8, as with the previous embodiment, separates out particles that might still be present in the air in a known manner from this air, which then passes into the flow chamber 38 (FIG. 1). Here the air flows downwardly between the motor 4 and the housing part 3. In the region within the undercarriage 1 an air deflection means 46 (FIG. 1) is provided via which the downwardly flowing air is deflected to the filter 11 and hence to the air outlet 10. Since the annular wall 20*a* projects axially beyond the dome part 22*a*, the separator is optimally protected from water spray and coarse dirt.

In conformity with the previous embodiment, the liquid container 2*a* is embodied in such a way that even if the wet cleaning apparatus is tipped over, no liquid can reach the separator 8 and the motor 4. The upper container part 16*a* is embodied in such a way that sufficient room is available between the separator and the cover 35 for accommodating liquid 9 in such an instance without the liquid reaching the separator. As a consequence of the protected arrangement of the separator, as with the previous embodiment there is ensured that even vibrations that can result when the wet cleaning apparatus is being used will not result in the separator 8 coming into contact with the liquid 9. As a consequence of a lesser loading of the suction air with liquid and/or solid particles, the functioning of the separator 8 is significantly improved.

In other respects, the wet cleaning apparatus with the liquid container 2*a* of FIGS. 7 to 9 has the same configuration as does the previous embodiment.

Figure 2:
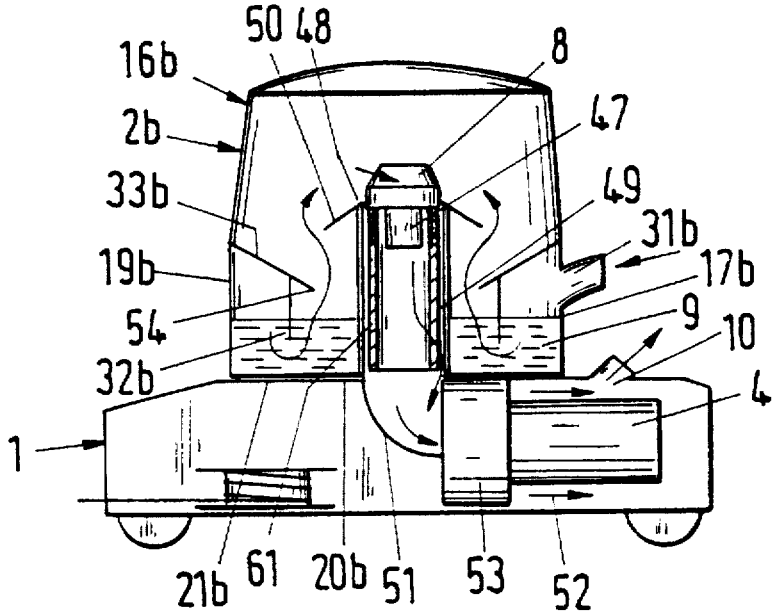
FIGS. 2 and 3 are axial cross-sectional views of further exemplary embodiments of the inventive wet cleaning apparatus.

FIG. 2 illustrates an embodiment having a similar configuration to that of the embodiment of FIG. 1. However, in this embodiment the separator 8 is not driven by the motor 4, but rather has its own motor 47. The motor 4 is accommodated in the undercarriage 1 and rests on its side, so that its axis is disposed horizontally. The liquid container 2*b* also has essentially the same configuration as with the embodiment of FIG. 1. The liquid container 2*b* has the upper container part 16*b*, which has the same configuration as in FIG. 1. The lower container part 17*b*, which is detachably connected to the upper container part 16*b*, has the two coaxial cylindrical walls 19*b* and 20*b* that are interconnected by the flat base 21*b*. The radial distance between the two annular walls 19*b* and 20*b* is greater than with the previous embodiment since the motor 4 is not accommodated on but rather within the undercarriage 1. The separator 8 is mounted on a cover 48 that covers the top of the receiving chamber that is surrounded by the annular wall 20*b*. The motor 47 for driving the separator 8 projects from above into the receiving chamber 49. To protect the separator 8 against splashes, a circumferential flange 50 is provided on the upper edge of the annular wall 20*b*. The flange 50 extends downwardly at an angle.

The receiving chamber 49 adjoins a deflection means 51 that is provided in the undercarriage for deflecting the suction air that flows downwardly in the receiving chamber 49 in a direction toward the air outlet 10, which is provided on the upper side of the undercarriage 1. The deflection means 51 has a channel-shaped configuration and connects the receiving chamber 49 with at least one horizontally extending flow chamber 52 through which the suction air can flow to the air outlet 10. The flow chamber 52 is embodied as an annular chamber that surrounds the motor 4. A blower or fan 53 is connected to and driven by the motor 4.

The dirty air that flows in through the air inlet connector in the lower container part 17*b* flows in the described manner through the liquid 9, where it is freed of dirt particles. The air flows through below the cylindrical wall 32*b*. The thus cleaned air subsequently flows upwardly to the separator 8 where particles that might still be present in the air are separated off. By means of the receiving chamber 49, the deflection channel 51, and the flow chamber 52 the cleaned suction air flows to the air outlet 10. To improve the protection against sprayed or splashed water, the conical intermediate wall 33*b* of the upper container part 16*b* is extended beyond the cylindrical wall 32*b*. The projecting edge 54, which extends downwardly at an angle, forms an excellent protection against splashed water. In conjunction with the flange 50 that is provided in the region above this edge 54, there is thus achieved an excellent protection for the separator 8 from splashed water.

Since the separator 8 with its motor 47 is rotatably driven independently of the motor 4, the optimum rotational speeds can be established for both of these components. Thus, in order to achieve a high cleaning effect, the separator 8 can be driven at a high speed, while a lower speed is quite sufficient for the suction blower 53. In other respects, the wet cleaning apparatus of FIG. 2 has the same configuration as does the embodiment of FIG. 1. Instead of the liquid container 2*b* on the portable undercarriage 1, a liquid container can also be provided where the air inlet connector is not disposed on the lower container part but rather, as with the embodiment of FIGS. 7 to 9, is provided on the upper container part 16*b*.

Also with the embodiment of FIG. 2, the liquid container 2*b* can be removed from the undercarriage 1 without the motor, so that a simple cleaning of the container is possible as was described in conjunction with FIG. 1 and FIGS. 4 to 6.

With the embodiment of FIG. 2 it is also possible to dispose the filter element 61 in the region between the separator 8 and the blower motor 4, whereby the discharged air must flow through this filter element. Furthermore, at least one heating means can also be provided.

Figure 3:
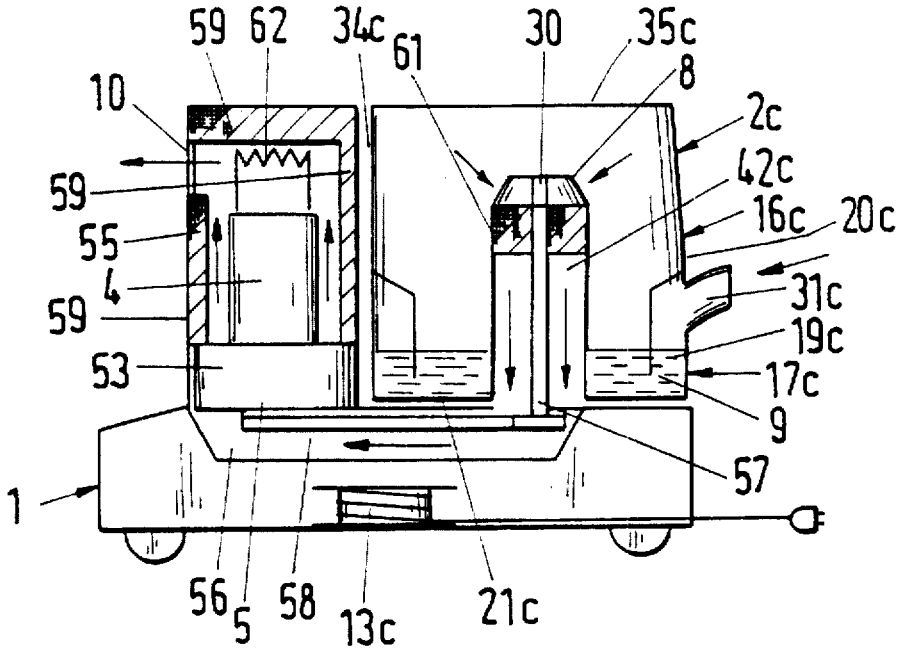

FIG. 3 shows an embodiment where the liquid container 2*c* is disposed on the undercarriage 1 in the region next to the motor 4. The liquid container 2*c* again comprises the upper container part 16*c* and the lower container part 17*c* that is detachably connected therewith. The lower container part 17c contains the cleaning fluid 9 and has the two coaxially disposed annular walls 19c, 20c. The radially inner annular wall 20c projects beyond the outer annular wall 19c and carries the separator 8. The outer annular wall 19c is additionally provided with the air inlet connector 31c.

The upper container part 16c has the flat cover 35c, which forms the upper termination of the wall 34c that, in contrast to the embodiment of FIGS. 1 and 2, is cylindrical. The wall 34c merges at its bottom end via a conical intermediate wall 33c into the cylindrical wall 32c, which like in the previous embodiments has a smaller radius than does the wall 34c. The upper container part 16c and the lower container part 17c, in contrast to the previous embodiments, are loosely placed upon one another. The cylindrical wall 32c, together with the intermediate wall 33c that is inclined radially inwardly, form the deflection mechanism for the dirty air that flows in via the air inlet connector 31c. The wall 32c is spaced from the flat bottom 21c of the lower container part 17c. The dirty air that is flowing in via the air inlet connector 31c can be guided within the lower container part 17c in a known manner, as was described in conjunction with FIGS. 10 and 11. A circular flow is imparted to the air so that due to the rotation in the liquid 9, the coarse dirt is preliminarily separated off, and the drawn-in dirty air remains in contact with the liquid 9 for a longer period. Since the separator 8 is disposed at a great distance above the liquid 9, it is not or hardly at all contaminated with splashed liquid. Contributing to this is the fact that the entry region for the dirty air is covered toward the top by the intermediate wall 33c.

As with the previous embodiments, the liquid container is provided with a handle so that it can be easily removed. For ease of illustration, this handle is not illustrated in FIG. 3.

The motor 4 is accommodated in a housing 55 that is disposed on the undercarriage 1 next to the liquid container 2c. The motor 4 is disposed upright so that its axis extends vertically. The motor 4 drives the blower or fan 53, which is similarly accommodated in the housing 55. The motor shaft 5 projects downwardly into a recessed area 56 in the upper side of the undercarriage 1. The shaft 30 of the separator 8 is coupled with an intermediate shaft 57 that extends parallel to the motor shaft 5a The two shafts 5 and 57 are drivingly interconnected, with this being accomplished in the illustrated embodiment by means of a belt drive 58. Instead of the belt drive 58, a chain drive, a toothed gear drive, and the like could also be provided. However, the belt drive 58 has the advantage that it produces little noise. The belt drive 58 is disposed in the recessed area 56.

The underside of the housing 55 is open and hence communicates with the recessed area 56. This recessed area extends in the longitudinal direction of the undercarriage 1 and is essentially closed off toward the top. Merely in the area of the receiving chamber 42c of the lower container part 17c is the recessed area 56 open. As a result, the cleaned air downstream of the separator 8 can enter the recessed area 56 via the receiving chamber 42c. Here the air flows in the longitudinal direction of the recessed area until it reaches the region below the housing 55. From the recessed area 56, the cleaned air, drawn in by the blower 53, flows upwardly in the direction of the indicated flow arrows and exits by at least one air outlet 10. The discharge opening of the recessed area 56 is adapted to the cross-sectional area of the housing 55.

The inner wall of the housing 55 is advantageously provided with sound dampening means 59 in order to achieve an optimum sound dampening or adsorption.

The liquid container 2c is advantageously secured to the undercarriage 1 by means of a non-illustrated central closure means. After such a central closure means has been released, the liquid container 2c can be easily lifted from the undercarriage 1. In this connection, the shaft 30 of the separator 8 is also withdrawn from the intermediate shaft 57, which is mounted on the undercarriage 1 in any suitable manner. The connection between the two shafts 30 and 57 is effected in a positive and/or frictional manner.

As with the previously described embodiments, the liquid container 2c has a cylindrical cross-sectional configuration. The housing 55 advantageously has a cylindrical cross-sectional configuration, although it can also have any other suitable cross-sectional configuration. The two housings 2c and 55 are advantageously the same height.

It is possible to rotatably drive the separator 8 in the liquid container 2c by a separate drive, as explained in conjunction with FIG. 2. In such a case, the separator 8 can be operated at a higher speed than is the blower 53. The cable reel 13c is rotatably mounted on the base within the undercarriage 1.

The filter element 61 can be disposed in the receiving chamber 42c. Furthermore, a heating means 62 can be provided in the housing 55 in order to heat up the discharged air before it exits via the air outlet 10. The heating means 62 is disposed downstream of the blower motor 4.

With all of the described embodiments, the liquid container 2, 2a–2c can be provided with an optical sensor that indicates how dirty the liquid 9 is. Such sensors are known and will therefore not be described in detail. Such an optical sensor can be embodied in such a way that it indicates to the user of the wet cleaning apparatus, by means of an optical and/or audible signal, that the liquid 9 has reached too high of a level of contamination. It is also possible to utilize this sensor signal to shut the wet cleaning apparatus off so that in any case the user is forced to change the liquid 9. If a prescribed level of contamination has been reached, the ability of the liquid to capture dirt drops so significantly that only a very low cleaning effect can still be achieved.

The liquid container 2, 2a, 2c can furthermore be provided with a fill indicator that is advantageously embodied in such a way that the user knows when a maximum and a minimum filling state have been achieved. In this case, an optical and/or audible signal is generated. It is also possible to utilize this signal for shutting off the motor 4. If the wet cleaning apparatus is operated with too little liquid, the particles that are present in the drawn-in dirty air are not sufficiently captured, so that a greater proportion of the dirt is carried along and is discharged at the air outlet. If the wet cleaning apparatus is utilized to suck in liquid, the danger of overfilling is present if the liquid level in the liquid container is too high. This danger is avoided in a simple manner by the described monitoring mechanism.

The wet cleaning apparatus comprises only two main components, namely the undercarriage 1 with the motor 4 and the cable reel, as well as the liquid container that is disposed in the region above or next to the motor or also can surround it, as shown in FIG. 1. As a consequence, the liquid container can be for filling and emptying be removed from the undercarriage 1 without the heavy motor. As a result of the described configuration, the wet cleaning apparatus is small in size and is significantly lighter in weight. The center of gravity of the wet cleaning apparatus is very low as a consequence of the described arrangement, so that the apparatus has an optimum stability.

The wet cleaning apparatus advantageously has a very low protective voltage of, for example, 24 V. As a result, safety measures with respect to insulation and protection against splashed water, as are necessary for apparatus operating on line voltages of 230 V, are not required.

The present invention is, of course, in no way restricted to the specific disclosure of the specification and drawings, but also encompasses any modifications within the scope of the appended claims.

What I claim is:

1. A wet cleaning apparatus having an intake connection and at least one air outlet opening, said apparatus comprising:

an undercarriage;

a motor that is disposed on said undercarriage and operates a blower for drawing in dirty air via said intake connection;

a liquid container that is removably disposed on said undercarriage and serves for accommodating cleaning liquid, wherein dirty air drawn in via said intake connection is conveyed into said cleaning liquid, which serves for filtering out dirt and dust from said dirty air; and a rotatably driven separator that, in a direction of flow of air through said wet cleaning apparatus, is disposed in said liquid container downstream of said intake condition for receiving air from said cleaning liquid and for filtering out dirt and dust not filtered out by said cleaning liquid, wherein said at least one air outlet opening is disposed downstream of said separator, and wherein said separator is disposed in said liquid container in such a way that when said liquid container is removed from said undercarriage, said separator is removed therewith while the motor remains with the undercarriage.

2. An apparatus according to claim 1, wherein said liquid container annularly surrounds said motor.

3. An apparatus according to claim 1, wherein said liquid container comprises two parts, namely a lower container part and an upper container part.

4. An apparatus according to claim 3, wherein said upper container part is provided with at least one handle.

5. An apparatus according to claim 1, wherein said separator is drivingly connected to said blower motor.

6. An apparatus according to claim 5, wherein said separator is positively connected to a shaft of said blower motor.

7. An apparatus according to claim 6, wherein a shaft of said separator and said shaft of said blower motor are aligned with one another.

8. An apparatus according to claim 7, wherein said shaft of said separator and said shaft of said blower motor are disposed vertically.

9. An apparatus according to claim 1, wherein a shaft of said separator is surrounded by said liquid container.

10. An apparatus according to claim 1, wherein a shaft of said separator is disposed parallel to a shaft of said blower motor.

11. An apparatus according to claim 10, wherein said shaft of said separator and said shaft of said blower motor are drivingly interconnected by drive means.

12. An apparatus according to claim 5, wherein said separator is drivingly connected with said blower motor via a magnet drive.

13. An apparatus according to claim 1, wherein said separator is provided with its own drive motor.

14. An apparatus according to claim 1, wherein said separator is securely connected to said liquid container.

15. An apparatus according to claim 1, wherein to protect said separator from splashing liquid, said liquid container is provided with at least one splash protection means.

16. An apparatus according claim 15, wherein said splash protection means is formed by a flange that projects from a wall of said liquid container.

17. An apparatus according to claim 1, wherein said liquid container is provided with a central receiving chamber that is open toward the bottom and is delimited by a vertical annular wall.

18. An apparatus according to claim 17, wherein said first annular wall is surrounded by and spaced from a further annular wall.

19. An apparatus according to claim 18, wherein said two annular walls are interconnected by a base.

20. An apparatus according to claim 18, wherein said inner first annular wall is provided with a cover at an upper end thereof, said cover partially closing off an upper portion of said receiving chamber, with a separator being disposed on said cover.

21. An apparatus according to claim 3, wherein said intake connection is disposed on said liquid container.

22. An apparatus according to claim 1, wherein said intake connection is disposed in such a way that inflowing air imparts rotation to liquid that is disposed in the liquid container.

23. An apparatus according to claim 3, wherein a deflection means, preferably a deflection plate, is disposed in the vicinity of said intake connection in such a way that a direction of flow of liquid in said container is counter to a direction of rotation of a separator.

24. An apparatus according to claim 3, wherein a cable reel-in mechanism is disposed in a region below said blower motor.

25. An apparatus according to claim 3, wherein said liquid container is provided with an indicator means having an optical sensor for indicating the degree of contamination of liquid in said liquid container.

26. An apparatus according to claim 3, wherein said liquid container is provided with a preferably optical indicator means for indicating a liquid level of said liquid container that is greater than or below prescribed levels.

27. An apparatus according to claim 3, which includes a portable undercarriage, wherein said liquid container is connected to said undercarriage via a central closure means.

28. An apparatus according to claim 3, wherein a noise dampening means, preferably in the form of a cassette, is disposed ahead of said air outlet opening.

29. An apparatus according to claim 28, wherein said noise dampening means is provided with a filter system for capturing microparticles.

30. An apparatus according to claim 29, wherein said filter system selectively comprises a dry or wet filter element or liquid bath.

31. An apparatus according to claim 27, wherein said blower motor is accommodated in said undercarriage.

32. An apparatus according to claim 31, wherein said blower motor is disposed on its side in said undercarriage.

33. An apparatus according to claim 27, wherein said blower motor is disposed upright on said undercarriage.

34. An apparatus according to claim 33, wherein said blower motor is disposed next to said liquid container.

35. An apparatus according to claim 27, wherein a cable reel-in mechanism is mounted in said undercarriage, preferably on a base thereof.

36. An apparatus according to claim 3, wherein said liquid container is provided with side walls, and wherein a flow obstructing means is spaced from said side walls and projects into liquid contained in said liquid container.

37. An apparatus according to claim 36, wherein said flow obstructing means extends parallel to said sidewalls of said liquid container.

38. An apparatus according to claim 36, wherein said flow obstructing means is an annular wall that projects downwardly from said upper container part.

39. An apparatus according to claim 3, wherein an air intake region in said liquid container is covered toward the top by a wall.

40. An apparatus according to claim 6, wherein at least one filter element is disposed in a region between said separator and said blower motor.

41. An apparatus according to claim 6, wherein in a direction of flow of air through said wet cleaning apparatus at least one heating element is disposed downstream of said separator.

42. An apparatus according to claim 30, wherein said filter element or liquid bath is provided with a separator.

43. An apparatus according to claim 1, wherein said separator is fixedly disposed on a driven shaft.

* * * * *